US010342352B2

(12) United States Patent
Coffield

(10) Patent No.: US 10,342,352 B2
(45) Date of Patent: Jul. 9, 2019

(54) LOAD BEARING SUPPORT SURFACE

(75) Inventor: Timothy P. Coffield, Grand Rapids, MI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 13/513,388

(22) PCT Filed: Dec. 27, 2010

(86) PCT No.: PCT/US2010/062131
§ 371 (c)(1),
(2), (4) Date: Jun. 1, 2012

(87) PCT Pub. No.: WO2011/082127
PCT Pub. Date: Jul. 7, 2011

(65) Prior Publication Data

US 2012/0237719 A1 Sep. 20, 2012

Related U.S. Application Data

(60) Provisional application No. 61/291,408, filed on Dec. 31, 2009.

(51) Int. Cl.

| | |
|---|---|
| *A47C 7/22* | (2006.01) |
| *A47C 7/28* | (2006.01) |
| *D03D 1/00* | (2006.01) |
| *D03D 25/00* | (2006.01) |

(52) U.S. Cl.
CPC ..... *A47C 7/22* (2013.01); *A47C 7/287* (2013.01); *D03D 1/0005* (2013.01); *D03D 25/005* (2013.01); *Y10T 428/24008* (2015.01)

(58) Field of Classification Search
CPC ..... A47C 7/287; A47C 7/22; D03D 25/005; D03D 1/0005
USPC ..... 428/99; 297/452.1, 452.48, 452.55, 297/452.56, 445.1, 440.11; 442/205, 206, 442/207; 525/66, 76
See application file for complete search history.

(56) References Cited

U.S. PATENT DOCUMENTS

| | | | | |
|---|---|---|---|---|
| 4,304,436 | A * | 12/1981 | Rowland | 297/239 |
| 4,469,739 | A | 9/1984 | Gretzinger et al. | |
| 4,603,907 | A * | 8/1986 | Witzke | 297/452.56 |
| 4,869,554 | A | 9/1989 | Abu-Isa et al. | |
| 5,582,463 | A * | 12/1996 | Linder et al. | 297/452.2 |
| 5,775,779 | A * | 7/1998 | Abu-Isa et al. | 297/452.56 |

(Continued)

FOREIGN PATENT DOCUMENTS

| | | |
|---|---|---|
| CN | 2362740 Y | 2/2000 |
| CN | 1395001 A | 2/2003 |

(Continued)

OTHER PUBLICATIONS

Frankland, Jim, Extrusion: Orientation: The Good and the Bad, Aug. 2016, PT—Plastics Technology, obtained from http://www.ptonline.com/columns/extrusion-orientation-the-good-and-the-bad.*

(Continued)

*Primary Examiner* — Brian Handville
(74) *Attorney, Agent, or Firm* — Levenfeld Pearlstein, LLC

(57) ABSTRACT

A load bearing surface assembly includes a molded component of oriented elastomeric material and an attachment loop connected to the molded component, the attachment loop configured to receive a frame member supporting the assembly.

38 Claims, 3 Drawing Sheets

(56) References Cited

U.S. PATENT DOCUMENTS

| | | | | |
|---|---|---|---|---|
| 6,540,950 | B1 | 4/2003 | Coffield | |
| 6,899,398 | B2 | 5/2005 | Coffield | |
| 6,966,606 | B2 | 11/2005 | Coffield | |
| 7,089,631 | B2 | 8/2006 | Catry et al. | |
| 7,096,549 | B2 | 8/2006 | Coffield | |
| 2003/0001424 | A1 | 1/2003 | Mundell et al. | |
| 2005/0172449 | A1 | 8/2005 | Carpinella | |
| 2006/0160943 | A1 | 7/2006 | Weir | |
| 2006/0267258 | A1 | 11/2006 | Coffield et al. | |
| 2010/0036043 | A1* | 2/2010 | Weber et al. | 524/504 |

FOREIGN PATENT DOCUMENTS

| | | | |
|---|---|---|---|
| CN | 1650774 | A | 8/2005 |
| CN | 2724518 | Y | 9/2005 |
| CN | 1756498 | A | 4/2006 |
| CN | 1816468 | A | 8/2006 |
| CN | 1817999 | A | 8/2006 |
| CN | 2847988 | Y | 12/2006 |
| CN | 2865439 | Y | 2/2007 |
| CN | 2868015 | Y | 2/2007 |
| CN | 1930237 | A | 3/2007 |
| EP | 0867332 | A2 | 9/1998 |

OTHER PUBLICATIONS

Rosato, D.V., Extruding Plastics: A practical processing handbook, 1998, Springer Science+Business Media Dordrecht, pp. 104-107 (Year: 1998).*

International Search Report and Written Opinion for PCT/US2010/062131 mailed Apr. 20, 2011.

* cited by examiner

LOAD BEARING SUPPORT SURFACE

CROSS-REFERENCE TO RELATED APPLICATIONS

The present application is a national phase of PCT/US2010/062131, filed Dec. 27, 2010 and claims the benefits of U.S. Provisional Application Ser. No. 61/291,408 filed Dec. 31, 2009.

FIELD OF THE INVENTION

The present invention generally relates to load bearing surfaces and more particularly to molded, elastomeric load bearing surfaces, such as the seat or back of a chair or bench, or the support surface of a bed, cot or other similar product.

BACKGROUND OF THE INVENTION

There are continuing efforts to develop new and improved load bearing surfaces. In the basic context of improving general load bearing surfaces, often it is desirable to improve durability in an inexpensive load bearing surface. In the context of seating and other body-support load bearing surface applications, often it is desirable to consider comfort issues as well. For example, with seating, it can be important to provide a surface that is comfortable and does not create body fatigue during periods of extended use. Given that the load characteristics such as stiffness, resiliency, force/deflection profile, desired in a particular surface will vary from application to application, it is also desirable to have a load bearing surface that is easily tunable during design and manufacture to provide load bearing surfaces that are optimized for different applications and uses.

It is known to provide molded load bearing surfaces for a wide variety of applications. For example, molded plastic chairs, such as lawn chairs, are available in a variety of forms. Although these molded surfaces provide an inexpensive option, they do not always provide the level of support and comfort available in more expensive load bearing surfaces, such as conventional cushion seats. To address the aforementioned limitations of molded loaded bearing surfaces, it is also known to provide a molded load bearing surface that is oriented after molding to provide the desired load bearing surface characteristics. U.S. patent application Ser. No. 11/423,540, filed by Coffield et al, on Jun. 12, 2006, entitled LOAD BEARING SURFACE, and published as United States Patent Application Publication 2006/0267258 is incorporated herein by reference in its entirety.

There remains an ongoing desire to provide a load bearing surface construction that provides the desired balance between cost and performance for different applications.

SUMMARY OF THE INVENTION

A load bearing surface assembly has an oriented, molded component with an attachment loop on each end of the molded component to provide a structure for securing the molded component to a support frame. In some embodiments, the attachment loops are separately manufactured and secured to the molded component. In such embodiments, the attachment loops may be manufactured from a wide variety of materials, such as canvas, polyester and TPU. In other embodiments, the attachment loop is integral with the molded component. For example, the molded component may be formed with one or more integral loops on each end.

In those embodiments in which the attachment loops are separately manufactured, the attachment loops may be secured to the molded component at alternative times during the manufacturing process. In one embodiment, the attachment loops are intersecured with the molded component by molding the molded component in place onto the attachment loops. In another embodiment, the attachment loops are secured to the molded component after molding, but before orienting. For example, the attachment loops may be secured to the molded component by stitching. In some embodiments, the attachment loops may be used to grip and hold the molded component during the orienting process. In yet another embodiment, the attachment loops are secured to the molded component after the orienting process is complete.

In an alternative embodiment, the attachment loops are formed integrally with the molded component. For example, the molded component may include edge structures that can be used to form loops to fit over frame components. In one embodiment, the edge regions of the molded component include a plurality of strips that can be alternately raised and lowered to define loops.

The present load bearing support surface provides a simple loop or tube like structure that can be slid or otherwise fitted over a frame component, such as a metal seat frame, wooden seat frame or other structures. The present invention provides an effective, yet inexpensive, attachment method that may be particularly useful in meeting the price point desired in residential construction.

Other features and advantages will become apparent to those skilled in the art upon review of the following detailed description, claims and drawings in which like numerals are used to designate like features.

Figure 1:
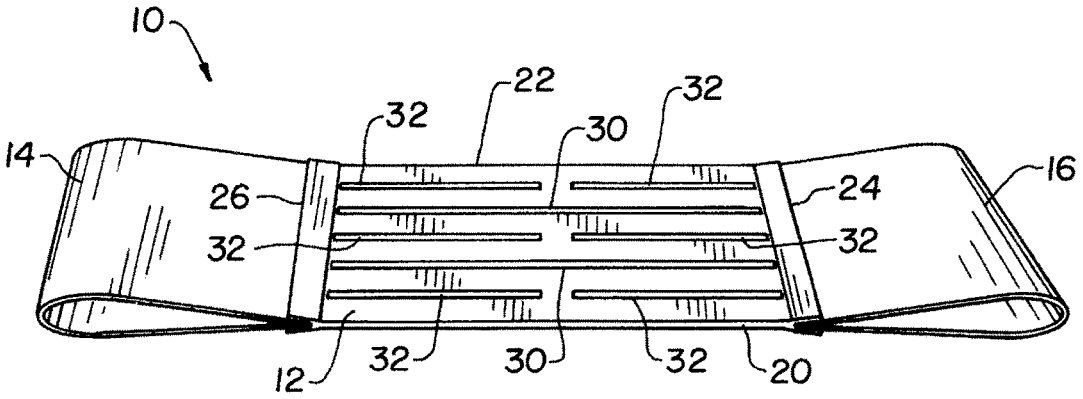
FIG. 1 is a perspective view of a load bearing support surface in a load bearing surface assembly.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a load bearing support surface is provided by way of a load bearing surface assembly 10. The load bearing surface assembly 10 generally includes a molded component 12 and a pair of attachment loops 14, 16 disposed on opposed edges of the molded component 12. Attachment loops 14, 16 provide a mounting structure for mounting the load bearing surface assembly 10 to a support structure via forming a pocket or sleeve in which support structure components are received. In some applications, the attachment loops 14, 16 may also be used to grip and hold the molded component 12 during an orienting process performed on molded component 12.

The illustrated load bearing surface assembly 10 is designed to function as the support surface for the seat of a chair or as a portion of the support surface for the seat of a chair. The load bearing surface assembly may, however, be incorporated into essentially any application where a resilient load bearing surface may be desired. In this embodiment, the load bearing surface assembly 10 includes four edges 20, 22, 24, 26 which, in the arrangement shown are a front edge 20, a back edge 22, a right edge 24 and a left edge 26. Terms implying direction, such as "front," "back," "left," "right," "top" and "bottom," and the like are used for ease of description in reference to the physical orientation shown in FIG. 1, and are not intended to limit the present invention to use in applications in which the load bearing surface assembly 10 is disposed in any specific positional relationship.

In the exemplary embodiment shown, molded component 12 is a generally rectangular molded part that is oriented to provide enhanced properties. Molded component 12 includes elongated voids or slots 30, 32 extending in the left/right direction to decouple regions of the molded component in the front/back direction. Slots 30 are continuous slots that extend almost entirely from one edge 24, 26 to the other edge 24, 26. Slots 32 are partial slots that extend intermittently along a line from one edge 24, 26 to the opposite edge 24, 26. The arrangement and configuration of slots 30, 32 may vary from one application or use for load bearing surface assembly 10 to another application or use thereof, to control the support and cushioning characteristics of load bearing surface assembly 10, and may include embodiments in which only continuous slots 30 or only intermittent slots 32 are used. The size, shape and configuration of molded component 12 may vary from application to application as desired. For example, the molded component may take essentially any desired geometric shape, such as square, round, elliptical and other more complex shapes, and may be of different sizes.

Molded component 12 may be manufactured from essentially elastomeric material capable of being oriented to provide the desired support and comfort characteristics. For example, molded component 12 may be a thermoplastic elastomer, such COPE (copolymer polyester), nylon-based TPE or a thermoplastic urethane. In the illustrated embodiment, molded component 12 is manufactured from a thermoplastic polyether ester elastomer block copolymer. Examples of suitable materials of this type include the material available from DuPont under the Hytrel® trademark, and the material available from DSM under the Arnitel® trademark. A variety of alternative elastomers may be suitable for use in the present invention. The thickness of molded component 12 will vary from application to application, depending on conditions in which it will be used and desired performance characteristics, such as, for example, the anticipated load to be supported and the desired stiffness of the surface.

Once molded component 12 is formed, it may be oriented to give it the desired physical characteristics. In the orienting process, for example, molded component 12 may be intentionally and permanently deformed such as by stretching in the direction along which the principle tensile loads will run during use. By orienting in this way prior to actual use, undesired deformation, referred to as "creep", that might otherwise occur from loading during use can be limited and potentially avoided altogether. In anticipation of orienting, molded component 12 is intentionally designed for an as "molded size" that is smaller than the required "in use" size by the amount that it will be enlarged by the permanent deformation brought on by the orienting process. In effect, the orienting process forces creep to occur in large part prior to actual use instead of during use of load bearing surface assembly 10. Forcing creep to occur in the manufacturing environment allows it to happen in a controlled and repeatable manner. The precise method and manner of orienting the molded component 12 may vary from application to application and may differ depending in part on the intended use of the load bearing surface assembly 10. A single act of stretching, repeated acts of stretching under the same or different conditions and compression by hammering or pressing are examples of suitable orienting processes for some applications. Molded component 12 may be oriented before or after attachment of the attachment loops 14, 16.

In the embodiment of FIG. 1, attachment loops 14, 16 are separately manufactured and secured together with molded component 12. In the illustrated embodiment, attachment loops 14, 16 are manufactured from a textile formed into a loop. The textile may be canvas or other materials of sufficient strength to bear the load encountered by load bearing surface assembly 10. The attachment loops 14, 16 need not be a textile, but instead may be essentially any material capable of being joined to molded component 12 while adequately bearing the loads to be supported. For example, the attachment loops may be manufactured also from polyester or TPU in some applications.

In the illustrated embodiment of FIG. 1, attachment loops 14, 16 are secured with the molded component 12 as an integral part of the molding process for molded component 12. More specifically, attachment loops 14, 16 of this embodiment are pre-manufactured and placed in the mold cavity when molding molded component 12 is molded. When the material of molded component 12 is injected into the mold cavity, it comes into contact with attachment loops 14, 16 in such a way that cured material is joined with attachment loops 14, 16. In some applications, the material of molded component 12 may pass through spaces between filaments or strands in the textile of attachment loops 14, 16 to provide an intimate and comprehensive bonding between attachment loops 14, 16 and the molded component 12.

Figure 2:
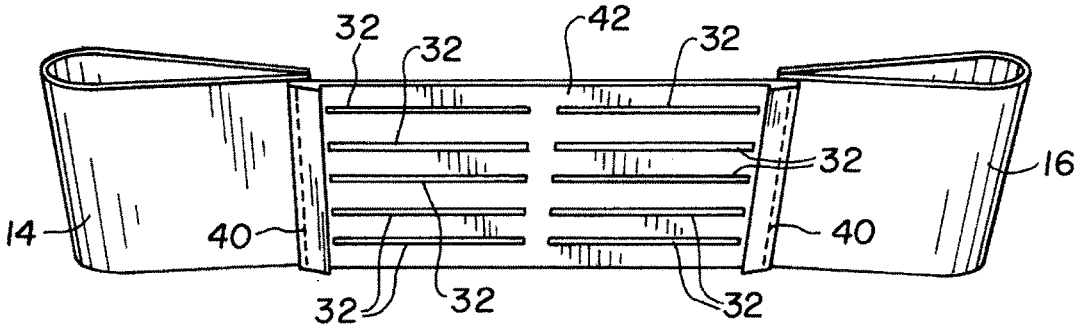
FIG. 2 is a perspective view of another load bearing surface assembly.
Figure 3:
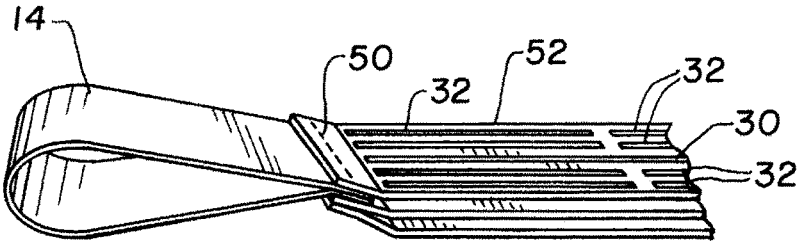
FIG. 3 is a perspective view of a further load bearing surface assembly.
Figure 4:
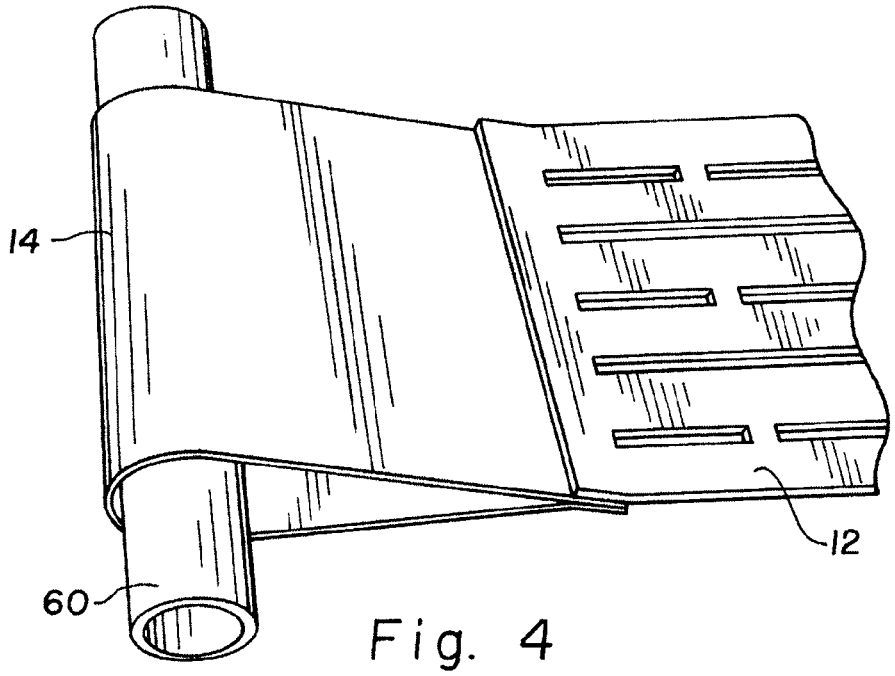
FIG. 4 is an enlarged, fragmentary perspective view of a load bearing surface assembly.

Alternatively, attachment loops 14, 16 may be attached to molded component 12 using other techniques. FIGS. 2-4 illustrate some other techniques that may be used for attaching attachment loops 14, 16 to a molded component. As one alternative technique for a load bearing surface assembly, attachment loops 14, 16 may be secured to a molded component by stitching attachment loops 14, 16 to the molded component after the molded component has been formed. FIG. 2 illustrates stitches 40 used for physically attaching loops 14, 16 to a molded component 42. Stitches 40 can be formed of suitable thread, filament or fiber of natural or synthetic materials using known sewing techniques. Stitches 40 can be continuously connected one to another, or can be independent of one another. In this alternative embodiment, it may be desirable to form a stitching groove or a line of stitching contours along the edges of the molded component 42 to facilitate the stitching process. The stitching groove (or line of stitching contours) provides reduced material thickness to make it easier to apply the stitching. Stitching also can be performed on an assembly as first described, in which attachment loops 14, 16 are secured with the molded component as an integral part of the molding process for the molded component. Stitches 50 are shown in FIG. 3 as an added means of attaching attachment loops to a molded component 52 that is also attached to the attachment loops as a result of the molding process as described previously. In still another alternative embodiment, the molded component may include edge details that allow a loop of material to be wrapped around the edge detail and be affixed back onto itself to form the attachment loop. Affixing the material of the loop back to itself can be achieved by any suitable technique, including, for example, stitching, bonding, securing with fasteners, etc. It should be understood that still other means can be used to attach attachment loops 14, 16 to a molded component, such as, for example adhesives or other bonding agents, physical fasteners of various types, and attaching processes such as welding and the like.

The number, size, shape and configuration of the attachment loops may vary from application to application. For example, in the embodiments shown, a single attachment loop 14, 16 extends along substantially the full length of a corresponding edge of molded component 12. If desired, the single attachment loop may be replaced by a plurality of attachment loops. Further, it is not necessary for the attachment loop(s) to extend along the entire edge of the molded component. For example, a plurality of attachment loops may be spaced apart from one another along an edge of the molded component or single or multiple attachment loops may be provided along less than the entire length of the edge of the molded component.

Although the attachment loops are shown along opposite edges of the molded components, the position of the attachment loops on a molded component may vary. For example, if it is desirable to support the molded component from more than two sides, attachment loops may be included along all desired edges. As another example, if the molded component is circular or elliptical, it may be desired to provide multiple attachment loops at select positions along the circumference of the molded component.

The load bearing surface assembly 10 may be mounted to essentially any frame 60 capable of receiving the attachment loops and adequately supporting the loads. Load bearing surface assembly 10 may be fitted over wood frame components, metal frame components, plastic frame components or other suitable supporting structures. It should be understood that the frame components may be of essentially any size shape or configuration capable of receiving the attachment loops and supporting the load bearing surface assembly. The spacing between the frame components may vary from application to application depending on the desired tension in load bearing surface assembly 10. Load bearing surface assembly 10 may be stretched and then mounted on the frame components in the stretched condition. Alternatively, load bearing surface assembly 10 may be mounted on the frame components and then the frame components may be moved apart to apply the desired tension. Another alternative is a hybrid of the preceding options. In this alternative, a portion of the desired stretch is applied to the load bearing surface assembly 10 as it is stretched to fit onto the frame components and then the frame components are moved apart to apply the remainder of the desired stretch.

Figure 5:
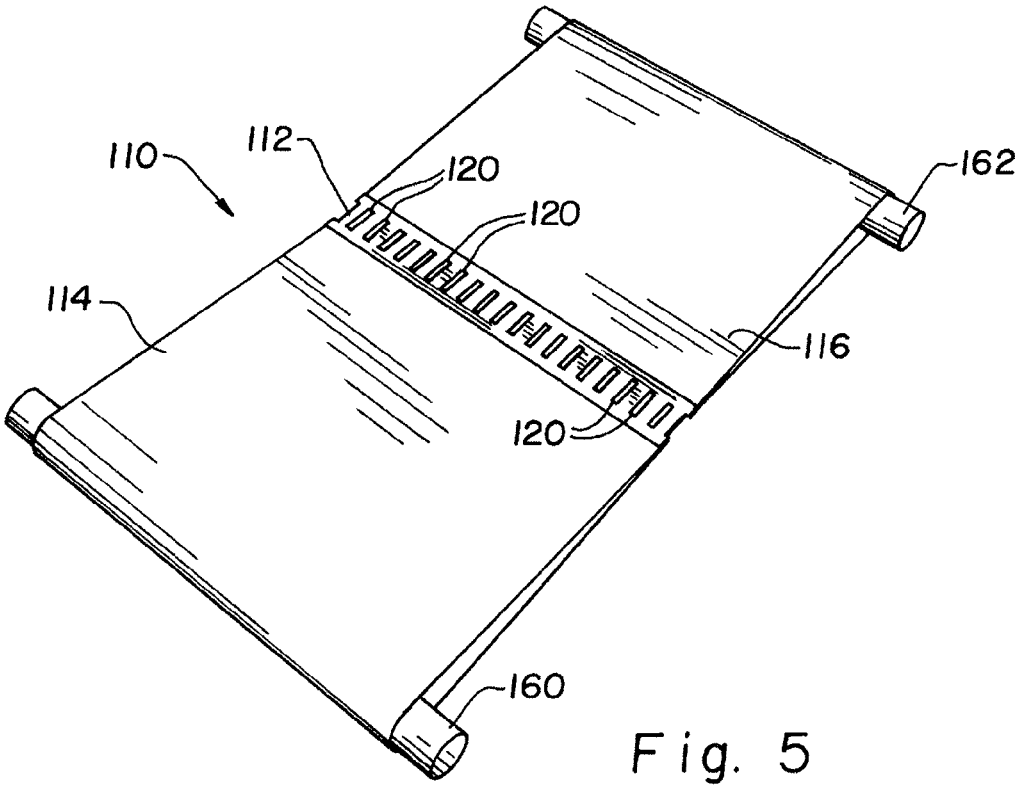
FIG. 5 is a perspective view of yet another load bearing surface assembly.

FIG. 5 shows a load bearing surface assembly 110 in accordance with an alternative embodiment in which the relative sizes of a molded component 112 and attachment loops 114, 116 differ substantially from the embodiments of FIGS. 1-4. In this embodiment, attachment loops 114, 116 form the majority of the load bearing surface, and molded component 112 forms only a narrow central portion of the load bearing surface. In this embodiment, the molded component 112 is oriented and defines a plurality of slots 120 that extend in the left/right direction to decouple regions of molded component 112 in the front/back direction between adjacent slots 120. As in the embodiments of FIGS. 1-4, the attachment loops 114, 116 are attached to the molded component 112 as an integral part of the molding process for the molded component 112, by stitching, by combinations of molding and stitching, or by other suitable means, such as bonding agents, physical fasteners and attachment processes such as welding and the like. The load bearing surface assembly 110 may be fitted over frame components 160, 162 other frame components, which may be wood, metal, plastics or other suitable structures.

Figure 6:
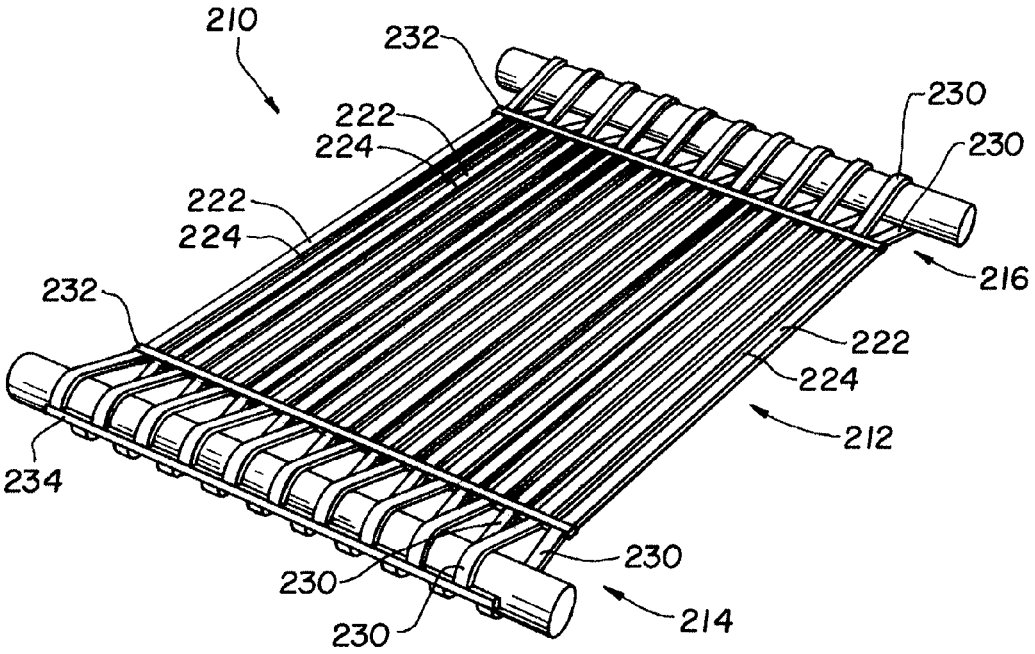
FIG. 6 is a perspective view of a still further load bearing surface assembly.

In an alternative embodiment, the load bearing surface assembly may include attachment loops that are integrally formed with the molded component as a single monolithic body. For example, as shown in FIG. 6, the load bearing surface assembly 210 includes a central region molded component 212 and side region attachment loops 214, 216 having a plurality of strips that can be used to form a plurality of loops for attachment purposes. In this embodiment, load bearing surface assembly 210 can be molded as a single monolithic structure of one material in a single molding process, or different materials can be used in a two shot process in which central region molded component 212 is made of a first material, and side region attachment loops 214, 216 are made of a second material. In the illustrated embodiment, the central region molded component 212 is generally rectangular and includes a plurality of generally parallel strips 222 spaced apart by slots 224. The size, shape and configuration of the central region molded component 212 may vary from application to application.

Attachment loops 214, 216 on opposites sides of central region molded component 212 each include a plurality of edge strips 230 that extend between a pair of loop bars 232, 234 arranged substantially transverse to central region strips 222 and edge strips 230, one being an inner loop bar 232 and the other being an outer loop bar 234. Edge strips 230 may be aligned with the central region strips 222 such that each set of edge strips 230 and central region strips 222 collectively extend in a continuous line across the load bearing surface assembly 210. As shown, loop bars 232, 234 may be integrally molded with the molded component central region strips 222 and edge strips 230. In other applications, a central region may not be divided into strips, but instead may be structured more like the molded components 12, 42, 52, 112 described previously herein. Accordingly, inner loop bars 232 may be eliminated. Although the loop bars 232, 234 of the illustrated embodiment extend continuously along essentially the complete edge of the central region molded component 212, the loop bars also may be broken into segments and the segments may be discontinuous. The edge strips 230 may be generally parallel, as shown, or they may have other orientations. In the illustrated embodiment, edge strips 230 extend in substantially the same plane as the central region strips 222 when molded. In use, adjacent edge strips 230 may be alternately raised and lowered in a repeating pattern to create a series of loops capable of being fitted over the desired frame. It is not necessary for the strips to be raised and lowered one alternate with the other. Instead, they may be raised and lowered in essentially any pattern that provides acceptable attachment to the frame, such as in a repeating pattern of two up and two down. In some applications, it may be desirable to form the edge strips 230 with the desired loop shape. For example, it may be desirable to mold the molded component with adjacent edge strips 230 in the desired alternating raised and lowered pattern.

During manufacture, the central region molded component 212 is oriented to provide the desired characteristics. Although the edge strips 230 and loop bars 232, 234 are not oriented with the central region molded component 212 in the illustrated embodiment, the edge strips 230 and loop bars 232, 234 may be oriented if desired. The load bearing surface assembly 210 may be fitted over frame components 260, 262 as shown in FIG. 6 or may be fitted on other frame components.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A load bearing support surface, comprising:

an elastomeric molded component, said elastomeric molded component being oriented by permanent deformation of the molded shape thereof, the molded component being made of at least one of a copolymer polyester, a nylon-based TPE or a thermoplastic urethane; and an attachment loop connected to said elastomeric molded component at an edge of said elastomeric molded component, the attachment loop formed from a closed loop of a textile or a resilient polymeric material, wherein the elastomeric molded component is a separate distinct component from the attachment loop that is mechanically attached to the attachment loop.

2. The load bearing support surface of claim 1, including first and second attachment loops connected to said elastomeric molded component.

3. The load bearing support surface of claim 1, said attachment loop being a loop of fabric.

4. The load bearing support surface of claim 3, including stitches connecting said attachment loop to said elastomeric molded component.

5. The load bearing support surface of claim 3, including first and second attachment loops and stitches connecting said first and second attachment loops to said elastomeric molded component.

6. The load bearing support surface of claim 3, said attachment loop extending substantially an entire length of an edge of said elastomeric molded component.

7. The load bearing support surface of claim 3, including first and second attachment loops extending substantially entire lengths of opposite edges of said elastomeric molded component.

8. The load bearing support surface of claim 7, including stitches connecting said first and second attachment loops to said elastomeric molded component.

9. The load bearing support surface of claim 1, said attachment loop being a plurality of molded elastomeric strips.

10. The load bearing support surface of claim 1, including first and second attachment loops each being a plurality of molded elastomeric strips.

11. The load bearing support surface of claim 1, said attachment loop connected to said molded component through an integral connection by molding.

12. The load bearing support surface of claim 11, including stitches through said attachment loop and said molded component.

13. The load bearing support surface of claim 1, including first and second attachment loops connected to said molded component through integral connections by molding.

14. The load bearing support surface of claim 13, including stitches through said molded component and said first and second attachment loops.

15. The load bearing support surface of claim 1, wherein the attachment loop is configured to grip and hold the molded component.

16. A load bearing support surface, comprising:

an elastomeric molded component, said elastomeric molded component being oriented by permanent deformation of the molded shape thereof, the molded component being made of at least one of a copolymer polyester, a nylon-based TPE or a thermoplastic urethane; and an attachment loop directly connected to said elastomeric molded component at an edge of said elastomeric molded component, wherein material of molded component passes through spaces between filaments and/or strands in the attachment loop, thereby providing an intimate and comprehensive bonding between attachment loop and the molded component.

17. The load bearing support surface of claim 1, wherein a plurality of attachment loops are directly connected to the elastomeric molded component.

18. The load bearing support surface of claim 17, wherein at least two attachment loops of the plurality of attachment loops are directly connected to opposing surfaces of the elastomeric molded component.

19. A load bearing support surface, comprising:

an elastomeric molded component; and an attachment loop connected to said elastomeric molded component at an edge of said elastomeric molded component, the attachment loop formed from a closed loop of a textile or a resilient polymeric material.

20. A load bearing support surface, comprising:

an elastomeric molded component, said elastomeric molded component being oriented by permanent deformation of the molded shape thereof; and an attachment loop directly connected to said elastomeric molded component at an edge of said elastomeric molded component, wherein material of the molded component passes through spaces between filaments and/or strands in the attachment loop, thereby providing an intimate and comprehensive bonding between attachment loop and the molded component.

21. The load bearing support surface of claim 19, wherein the elastomeric molded component is oriented by permanent deformation of the molded shape thereof.

22. The load bearing support surface of claim 21, the molded component being made of at least a copolymer polyester.

23. The load bearing support surface of claim 21, the molded component being made of at least a nylon-based TPE.

24. The load bearing support surface of claim 21, wherein the elastomeric molded component is a separate component from the attachment loop.

25. The load bearing support surface of claim 21, the molded component being made of material different from that of the attachment loop.

26. The load bearing support surface of claim 1, the attachment loop being made of material different from that of the molded component.

27. The load bearing support surface of claim 19, wherein the elastomeric molded component is a separate distinct component from the attachment loop that is mechanically attached to the attachment loop.

28. The load bearing support surface of claim 1, further comprising a second attachment loop directly connected to said elastomeric molded component at another edge of said elastomeric molded component, wherein the load bearing surface includes only two attachment loops.

29. The load bearing support surface of claim 27, further comprising a second attachment loop directly connected to said elastomeric molded component at another edge of said elastomeric molded component, wherein the load bearing surface includes only two attachment loops.

30. The load bearing support surface of claim 1, wherein the elastomeric molded component has an outer periphery in the form of a rectangle, and two of the sides are free of connection to any attachment loop.

31. The load bearing support surface of claim 27, wherein the elastomeric molded component has an outer periphery in the form of a rectangle, and two of the sides are free of connection to any attachment loop.

32. The load bearing support surface of claim 19, wherein the elastomeric molded component comprises a material oriented by permanent deformation.

33. The load bearing support surface of claim 19, wherein the elastomeric molded component is configured to resist creep from loading during use.

34. The load bearing support surface of claim 19, wherein the elastomeric molded component is configured to avoid altogether creep from loading during use.

35. The load bearing support surface of claim 19, wherein the elastomeric molded component is a product resulting from the action of applying at least one act of stretching so as to permanently deform the component.

36. The load bearing support surface of claim 19, wherein the elastomeric molded component is a product resulting from forcing creep to occur so that subsequent application of force normal use will not cause creep.

37. The load bearing support surface of claim 19, wherein the elastomeric molded component is oriented by permanent deformation of the molded shape by stretching in the direction along which the principle tensile loads will run during use.

38. The load bearing support surface of claim 19, wherein the loops are a textile material.

* * * * *